United States Patent [19]

Adelman

[11] 4,399,979

[45] Aug. 23, 1983

[54] DEVICE FOR SELF-TAILING A CONVENTIONAL WINCH DRUM

[76] Inventor: Michael R. Adelman, 4884 MacArthur Blvd., Washington, D.C. 20007

[21] Appl. No.: 4,840

[22] Filed: Jan. 19, 1979

Related U.S. Application Data

[63] Continuation of Ser. No. 866,915, Jan. 4, 1978, abandoned.

[51] Int. Cl.[3] ..... B66D 1/30

[52] U.S. Cl. ..... 254/338; 254/371; 114/218

[58] Field of Search ..... 254/371, 369, 336, 323, 254/344, 338; 114/218

[56] References Cited

U.S. PATENT DOCUMENTS

| | | | |
|---|---|---|---|
| 3,483,841 | 12/1969 | Blackburn | 114/218 |
| 3,580,209 | 5/1971 | Olson | 114/218 |
| 3,678,876 | 7/1972 | Alter | 114/218 |
| 3,730,483 | 5/1973 | Newell | 254/371 |
| 3,985,340 | 10/1976 | Guangorena | 254/371 |

FOREIGN PATENT DOCUMENTS

| | | | |
|---|---|---|---|
| 524115 | 7/1946 | United Kingdom | 254/371 |

*Primary Examiner*—Joseph J. Rolla
*Assistant Examiner*—Kenneth Noland
*Attorney, Agent, or Firm*—Bacon & Thomas

[57] ABSTRACT

A device for self-tailing a conventional winch drum utilizing the motion of the hauled in line under load to provide, through a multiple sheave assembly, the tension on the free end of the line necessary to render the winch drum operational and properly haul in the line.

2 Claims, 6 Drawing Figures

FIG. 1
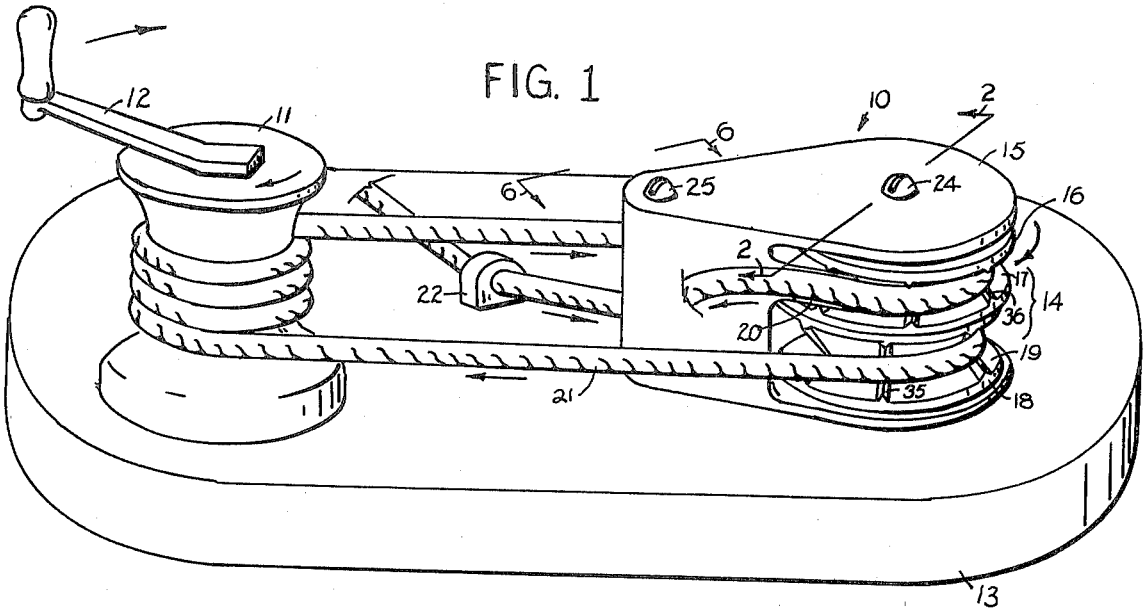
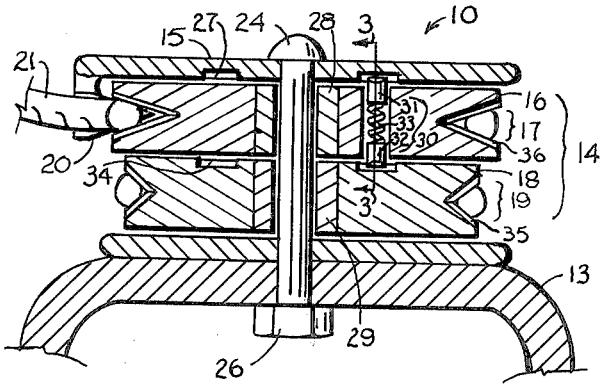
FIG. 2
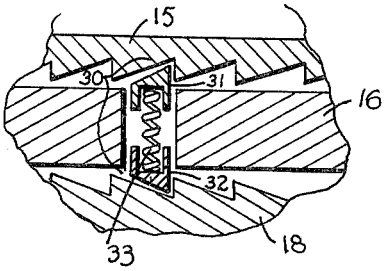
FIG. 3

FIG. 4
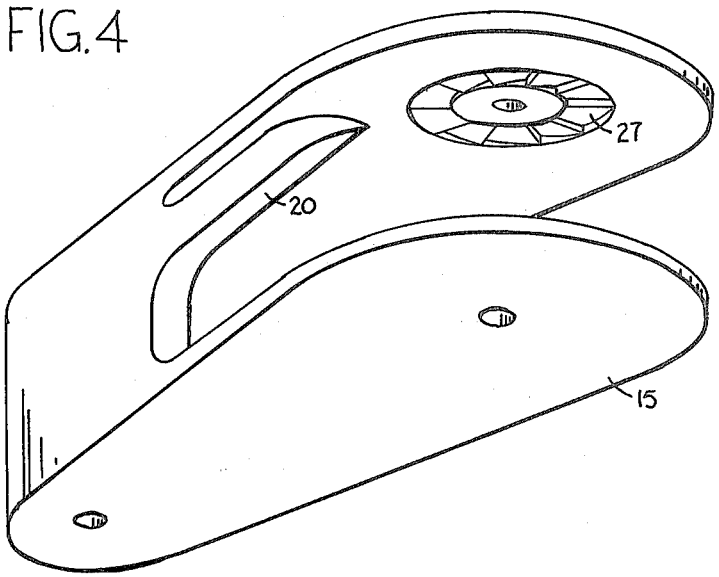
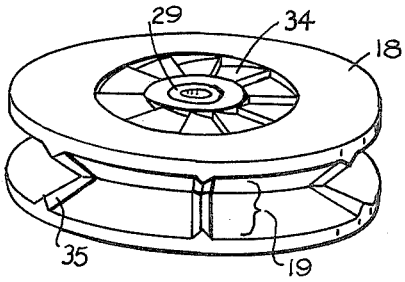
FIG. 5
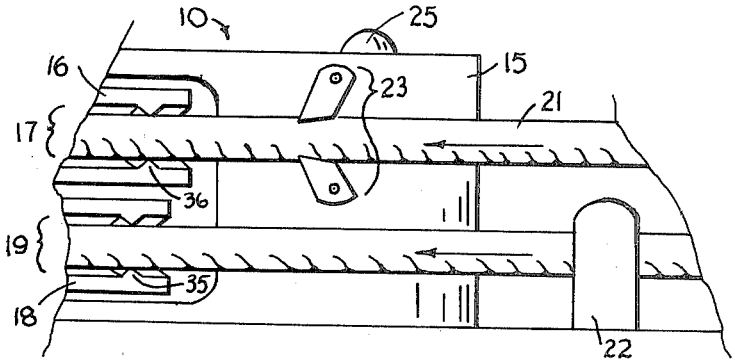
FIG. 6

DEVICE FOR SELF-TAILING A CONVENTIONAL WINCH DRUM

This is a continuation of application Ser. No. 866,915, filed Jan. 4, 1978, now abandoned.

REFERENCES CITED

U.S. Pat. Nos.
3,730,483—5/1973—Newell
3,968,953—7/1976—Guangorena
3,985,340—10/1976—Guangorena
4,026,525—5/1977—Declercq

BACKGROUND OF THE INVENTION

This invention relates to a device which provides a means for self-tailing a conventional winch drum utilized for the hauling in of flexible line (or rope) and particularly, but not limited to, those utilized on recreational sailing vessels. These conventional winches are generally comprised of a drum section which is free to rotate and/or may be forcefully rotated, generally utilizing a winch handle, in the clockwise direction, but are restricted from rotation in the counterclockwise direction. In conventional operation, a line directed from the load to be hauled in is generally led through a fairlead or other guide to the winch drum about which several clockwise turns are taken. The line is generally hauled in manually, whereupon the drum rotates freely in the clockwise direction, until such time that the load increases to the point at which the drum must be forcefully rotated in the clockwise direction. During the forceful turning of the drum, a relatively smaller tension than the load to be hauled in must be maintained on the free end of the line such that frictional forces are developed between the turns of the line and the drum. These frictional forces cause the line to be hauled in as the drum is forcefully turned. The maintenance of the relatively smaller tension on the free end of the line while the line is hauled in by the winch drum is generally referred to as "tailing."

Heretofore, several devices have been developed to provide an automatic or "self-tailing" capability for the conventional winch drum. Several such devices are described in U.S. Pat. Nos. 3,730,483; 3,968,953; 3,985,340; and 4,026,525. Associated with each of the previously developed devices have been certain disadvantages or limitations. These are most generally characterized as limitations to a particular type, weave, or size of line; a tendency to provide a tailing tension of such excessive magnitude so as to damage or break the line; or a design which requires the self-tailing mechanism to be manufactured integral with or be mounted in physical contact with and directly utilize the motion of the conventional winch drum for proper and intended operation. In addition, the rotational speed at which the line left the winch drum and entered the previous self-tailing devices was required to be identical. In many cases, whereas the devices are operationally successful, expense due to the replacement of existing conventional winch drums with a new device of complicated design renders the utilization of such devices impractical.

Therefore, among the objects of the present invention are to provide a device for the self-tailing of a conventional winch drum which is simpler in its general configuration and provides increased versatility in its operation.

Another object of the invention is to provide a means of self-tailing a conventional winch drum which will operate smoothly and efficiently with a wide variety of line types, weaves or sizes while assuring proper tailing tension.

Another more specific object of the invention is to provide a means for self-tailing a conventional winch drum which is comprised of a relatively small number of parts that are easy to assemble and maintain and do not require the self-tailing mechanism to be manufactured integral with or be mounted in physical contact with and directly utilize the motion of the conventional winch drum for proper and intended operation. In addition, the rotational speed at which the line leaves the winch drum will be independent of the speed at which the line enters the self-tailing device.

Still another object of the present invention is to provide a means of self-tailing a conventional winch drum that is particularly well adapted for ease and economy of manufacture.

SUMMARY OF THE INVENTION

The present invention provides a device which is utilized in conjunction with a conventional winch drum to provide a means for self-tailing a line being hauled in on the said winch drum.

The said device consists of a multiple sheave assembly which is rotatably supported in a stationary frame. The rotatable support of the multiple sheave assembly provides for the rotation of the said assembly in a predetermined direction. The said multiple sheave assembly consists of an upper sheave, provided with a line gripping angular groove, and a lower sheave, provided with a frictional angular groove. Relative rotation of the upper and lower sheaves with respect to each other is also provided in a predetermined direction. A finger which is integral to the stationary frame protrudes into the line gripping angular groove of the upper sheave.

In operation, line to be hauled in under load is reeved through an appropriate guide and then around the lower sheave of the present invention. From the lower sheave, several turns are taken around the winch drum in the conventional manner. The line is then reeved, under some tension, into and around the line gripping angular groove of the upper sheave. As the line is wound up and hauled in on the winch drum operated in the conventional manner, the incoming motion of the line or rope is imparted on and turns the lower sheave of the multiple sheave assembly due to the friction developed in the frictional angular groove. As provided, the lower sheave rotates the upper sheave and the line gripping angular groove, thus pulling in and maintaining the required tailing tension on the line. As this operation progresses, the line hauled in is ejected from the line gripping angular groove in the upper sheave by a finger protruding into the line gripping angular groove.

Other objects, advantages and features of the present invention will become apparent from the following detailed description of the preferred embodiment thereof, presented in conjunction with the accompanying drawings.

BRIEF DESCRIPTION OF THE DRAWINGS

FIG. 1 is a view in perspective of the preferred embodiment of a Device for Self-tailing a Conventional Winch Drum embodying the principles of the invention.

FIG. 2 is a view in elevation and in section of the device of FIG. 1 taken along the line 2—2.

FIG. 3 is a fragmentary view in elevation and in section of a detail of the device as shown in FIG. 2 taken along the line 3—3.

FIG. 4 is a perspective view of the mounting bracket utilized in the device shown in FIG. 1.

FIG. 5 is a perspective view of the lower sheave utilized in the device shown in FIG. 1.

FIG. 6 is a fragmentary view in elevation of the hidden side of an alternate embodiment of a device shown in FIG. 1 along line 6—6.

DESCRIPTION OF A PREFERRED EMBODIMENT

With reference to the drawings, a preferred embodiment of a device 10 which provides for the self-tailing of a conventional winch drum 11 is shown in perspective in FIG. 1. As illustrated, it generally comprises a conventional winch drum 11 which is free to rotate and/or may be forcefully rotated against a load in the clockwise direction generally utilizing a winch handle 12 (or other means) but is restricted from rotation in the counter clockwise direction. The device 10 which is situated to operate in conjunction with the winch drum 11 is mounted on a common base 13. In this embodiment, the said device 10 consists of a multiple sheave assembly 14 which is rotatably supported on a stationary frame 15. The rotatable support of the multiple sheave assembly 14 provides for the rotation of the said assembly with respect to the stationary frame 15 in a predetermined direction as indicated in FIG. 1. The said multiple sheave assembly 14 consists of an upper sheave 16, provided with a line gripping angular groove 17, and a lower sheave 18, provided with a frictional angular groove 19. Relative rotation of the upper and lower sheaves with respect to each other is provided in a predetermined direction and will be discussed below in further detail. The relative rotation of the upper sheave 16 with respect to the lower sheave 18 is not indicated on FIG. 1. A finger 20 which is integral to the stationary frame 15 protrudes into the gripping angular groove 17 of the upper sheave 16. In the arrangement disclosed in FIG. 1, line 21 to be hauled in under load is shown reeved through an appropriate guide 22 and then around the lower sheave 18. From the lower sheave 18, several turns have been taken about the winch drum 11 in the conventional manner. The line 21 has then been reeved, under some tension, into and around the gripping angular groove 17 of the upper sheave 16. The line is directed out of the gripping angular groove 17 by the finger 20. Further details of the said device will be revealed in the following paragraphs.

Turning now to FIG. 2 and the additional figures, the details of the device 10 will become understood as the description progresses. It will be seen that the device 10 consists of a stationary frame 15 onto which the multiple sheave assembly 14 is mounted. Bolt shaft 24, acting as the axis of rotation of multiple sheave assembly 14, is utilized in conjunction with bolt 25 and nuts 26 (one shown) to attach the device 10 to the common base 13. Several other features of the stationary frame 15 are the finger 20 and the formed teeth 27. The configuration of the finger 20 and the formed teeth 27 for the preferred embodiment of the stationary frame 15 is further clarified in FIG. 4. The operation and purpose of these additional features will become clearer as the description progresses.

The multiple sheave assembly 14 is mounted on the bolt shaft 24 in a manner which will permit rotation of each sheave. In this embodiment the upper sheave 16 and lower sheave 18 are mounted utilizing bushings 28 and 29 which are installed utilizing a press interference fit. Of course, other embodiments may utilize other arrangements, such as antifriction bearings. To facilitate the rotation of the multiple sheave assembly 14 in a predetermined direction with respect to the stationary frame 15, a ratchet assembly 30, shown in further clarity in FIG. 3, is mounted in the upper sheave 16. The ratchet assembly 30 also facilitates the rotation in a predetermined direction of the lower sheave 18 with respect to the upper sheave 16. The ratchet assembly 30 consists of pawls 31 and 32 which are urged by spring 33 into formed teeth 27 in the stationary frame 15 and formed teeth 34 in the lower sheave 18. The configuration of the formed teeth 34 in the lower sheave 18 for the preferred embodiment is further clarified in FIG. 5. In operation, the ratchet assembly 30 provides for rotation of the multiple sheave assembly 14 with respect to the stationary frame 15 in the clockwise direction only, while also providing for the counterclockwise rotation of the lower sheave 18 with respect to upper sheave 16. It should be noted that this arrangement also provides that when the lower sheave 18 is turned in the clockwise direction, the upper sheave 16 will be turned with it in the clockwise direction.

The desired self-tailing of a winch drum could also be accomplished in an alternate embodiment which does not include the aforementioned ratchet assembly 30, but with the upper and lower sheaves 16 and 18 of the multiple sheave assembly 14 joined to rotate together about the bolt shaft 24. This resultant alternate embodiment is outwardly identical to the preferred embodiment as illustrated in FIG. 1, with the exception of the addition of a self-acting cleat or spray 23 on the hidden side of device 10. The mounting of the self-acting cleat on the alternate embodiment is further clarified in FIG. 6. The self-acting cleat 23 may also be mounted on the common base 13. The operation of this alternate embodiment is discussed further below. However, the advantages to be gained by restricting the rotation of the upper and lower sheaves 16 and 18 with respect to each other and the stationary frame 15 utilizing the ratchet assembly 30 will become clear from the explanation of the operation of the preferred embodiment which follows.

As noted above, each of the sheaves (16 and 18) of the present invention is characterized by an angular groove provided to facilitate the desired operation of the device 10. In the preferred embodiment, the upper sheave 16 is provided with a line gripping angular groove 17 with raised ribs 36 at an angle of approximately 45 degrees. These ribs 36 are provided such that when a line 21 under load is engaged within the gripping angular groove 17, forced rotation of the sheave 16 in a direction against a load will further capture or jam the line 21 within the groove and pull the line against the load in general movement corresponding to the sheave rotation. Of course the preferred and many other embodiments of the gripping angular groove, including those of prior art, which will provide such a capture of the engaged line by the groove may be fabricated by a person skilled in the art.

In the preferred embodiment, the lower sheave 18 is provided with a frictional angular groove 19 with raised ribs 35 at an angle of approximately 90 degrees configured such that a sufficient frictional force between a line and the lower sheave 18 will be developed such that when the line 21 under load is pulled through the sheave during its intended operation as indicated in FIG. 1, the sheave will turn with it but the rope will not be captured within the groove. Of course, the preferred and many other embodiments of a frictional angular groove which will provide a frictional force between the line and groove may be fabricated by a person skilled in the art.

It should be noted that the effective diameter of the upper sheave 16, herein defined as the diameter at which a line or rope rests within the angular groove of a sheave, is generally larger than the effective diameter of the lower sheave 18. This is generally required for the proper operation of the said device because of stretch in the line under load and will be further discussed below. It is also noted that some line gripping groove configurations of the prior art, most notably those utilizing clamp rings urged together by a spring force, were conceived to provide an effective diameter equal to that of the winch drum. As the discussion of the operation of the said device progresses, it will become clear that the effective diameter of the upper sheave 16 and winch drum 11 or the lower sheave 18 are not required to be equal for the proper operation of the said device 10.

Thus, in operation, the line 21 to be subjected to a load to be hauled in is led through a fairlead or other guide 22 and then around the lower sheave 18 of the device 10. From the lower sheave 18, several turns are taken around the winch drum 11 in the conventional manner. At this stage, the operation is essentially conventional, in that the line 21 may be hauled in by forcefully turning the winch drum 11 utilizing the handle 12 (in a direction corresponding to the arrows in FIG. 1) and providing conventional tailing. The line 21 may also be paid out by easing the tailing tension on the free end of the line in the conventional manner. In this mode of operation, the lower sheave 18, as described above, is free to rotate in the clockwise direction when hauling in line 21, turning with it the upper sheave 16. The lower sheave 18 is free to rotate along in the counterclockwise direction when paying out line, thus affording smooth operation.

When self-tailing is desired, indeed the most important object of the present invention, the line 21 is then reeved, under some tension, into and around the gripping angular groove 17 of the upper sheave 16. Then to haul in the line 21, the winch drum 11 is forcefully turned in the direction indicated by the arrows in FIG. 1. As the line 21 is wound up and hauled in on the winch drum 11, the incoming motion of the line 21 is imparted on and turns the lower sheave 18 of the multiple sheave assembly 14. As provided, the lower sheave 18 rotates the upper sheave 16 in the clockwise direction, thus pulling in and maintaining the required tailing tension on the line 21. The tailing tension developed will never exceed the frictional force developed between the line 21 under load and the frictional angular groove 19 in the lower sheave 18, thus protecting the line from damage. As the line 21 is hauled in, it is ejected from the gripping angular groove 17 of the upper sheave 16 by the finger 20. When the desired length of rope has been hauled in, forceful turning action is ceased. In the preferred embodiment shown in FIG. 1, the upper sheave 16, restricted from rotation in the counterclockwise direction by the ratchet assembly 30, maintains the tailing tension on the line 21 thus preventing it from paying out. In the alternate embodiment described above and shown in detail in FIG. 6, the self-acting cleat 23 in which the line 21 is riding prevents the line from paying out (in a direction opposite that indicated by the arrows) when the forceful turning action of the winch drum 11 is ceased. In order to pay out the line 21, the line is manually or otherwise pulled from the gripping angular groove 17 (and the self-acting cleat 23 of the alternate embodiment) and payed out in the conventional manner.

The features described above in the preferred embodiment are readily made in the correct size and configuration depending on the size of the winch drum and the general uses to which it is to be put, all of which a man skilled in the art will have no trouble accomplishing.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

Having thus set forth and disclosed the nature of this invention, what is claimed is:

1. A device for self-tailing a winch, comprising:

a frame member having a pair of coaxial sheaves journalled thereon, a first one of said sheaves having a groove configured to securely grip a line and the second sheave having a groove configured to frictionally receive a line;

a clutch device connecting said sheaves for positively rotating said first sheave by said second sheave in at least one direction; and means adapted to prevent rotation of at least said first sheave in the other direction, whereby a line to be hauled may be reeved in the groove of said second sheave, trained around a winch or the like then reeved in the groove of said first sheave and thereby effect self-tailing when said line is hauled by said winch to rotate said second sheave in said one direction.

2. A device as defined in claim 1 wherein said last-named means comprises a ratchet mechanism between said second sheave and said frame.

* * * * *